United States Patent [19]

Smith

[11] 4,043,079

[45] Aug. 23, 1977

[54] AUTOMATIC LATCH DOOR APPARATUS

[76] Inventor: Walter E. Smith, 3773 Casey Drive, Vancouver, British Columbia, Canada, V8Z 4J6

[21] Appl. No.: 746,846

[22] Filed: Dec. 2, 1976

[51] Int. Cl.[2] ..... E05B 65/06; E05C 19/02

[52] U.S. Cl. ..... 49/394; 49/169; 119/19

[58] Field of Search ..... 49/169, 168, 163, 170, 49/171, 394, 503; 119/19, 155

[56] References Cited

U.S. PATENT DOCUMENTS

| | | | |
|---|---|---|---|
| 3,811,224 | 5/1974 | Garrison | 49/168 |
| 3,878,645 | 4/1975 | Porter | 49/169 |
| 3,918,203 | 11/1975 | Ellison, Jr. | 49/168 |

*Primary Examiner*—Philip C. Kannan
*Attorney, Agent, or Firm*—Fetherstonhaugh & Company

[57] ABSTRACT

Door apparatus having spaced panels forming a closure and hanging in a vertical closing position and hung to swing back and forth as a unit, a latch mounted on the inner surface of each panel near the lower edge thereof and engaging a stop to prevent movement of the panel away from the other panel while permitting movement towards said other panel, and operating means on each panel operatively connected to the latch thereof. When either panel is swung towards the other panel it engages the operating means of the latter to operate the latch thereof to disengage its stop, thereby allowing the panel unit to swing out of the closing position.

11 Claims, 6 Drawing Figures

AUTOMATIC LATCH DOOR APPARATUS

Figure 1:
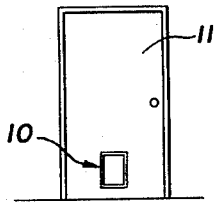

This invention relates to door apparatus which is normally latched in a closed position and which is unlatched to allow the door apparatus to move in either of opposite directions to an open position merely by the application of pressure against either of the two outer faces thereof.

Although this door apparatus was primarily designed to act as door for pets, and is so described herein for convenience, it may be used for other purposes. The door apparatus for pets is preferably hung from the top thereof, but it may be swingably mounted at one side edge. In either case, the door apparatus may be relatively small so that it can be fitted into a normal house door or into a building wall so that pets can get in and out without the necessity of anyone having to open doors for them, or it can be made on a larger scale so as to act as a closure for a building.

Many people have a house pet, such as a cat or a dog, which frequently has to be let out of and allowed back into the house. This usually means that someone has to open a door to permit the pet to go out or come in. There are pet doors in the prior art, but these evidently have not proved very satisfactory as evidenced by the fact that there are practically no pet doors on the market. Some of the pet doors of the prior art are rather cumbersome and therefore expensive, others can be blown open by wind, resulting in drafts and cold air within the building, others are unsightly, and some cannot be locked in the closed position.

The present door apparatus is automatic in operation, that is, it is self-closing and self-latching. This door apparatus is released and opened merely by pressure against either side thereof. It cannot be blown open by wind, its construction is extremely simple and very reliable, and it has a very neat appearance. This door apparatus is unually placed in a door since it is very easy to prepare a door for its reception, but it can be inserted in any wall. In the latter case, the door apparatus would usually be inserted in the wall during the construction thereof.

This door apparatus is constructed so that it can be opened by a pet merely by pressing its nose or paw or body against it. Once the pet is through the opening, the door apparatus returns to its normal closing position and is automatically latched in said position.

Automatic latch door apparatus in accordance with this invention comprises spaced panels forming a closure and normally located in a closing position in vertical planes and having adjacent edges movable out of said planes on either side thereof, latch means on each of said panels near said edge thereof and normally preventing movement thereof in the direction away from the other of said panels while permitting movement in the direction towards said other panel, and operating means on each panel operatively connected to the latch means on said each panel, the operating means of each panel being positioned to be engaged and operated by the other panel when said other panel is moved towards said each panel thereby operating the latch means and consequently releasing said each panel to permit the latter to move with said other panel.

More specifically, this door apparatus comprises spaced panels forming a closure and normally hanging in a vertical closing position and hung to swing as a unit out of their normal planes on either side thereof, a latch mounted on each of said panels near a lower edge thereof normally projecting from said edge to engage a stop located near said each panel to prevent movement thereof in the direction away from the other of said panels while permitting movement in the direction towards said other panel, operating means on each panel operatively connected to the latch on said each panel, the operating means of each panel being positioned to be engaged and operated by the other panel when said other panel is moved towards said each panel thereby operating the latch of said end panel to disengage the adjacent stop and consequently release said each panel to permit the latter to move with said other panel.

Figure 2:
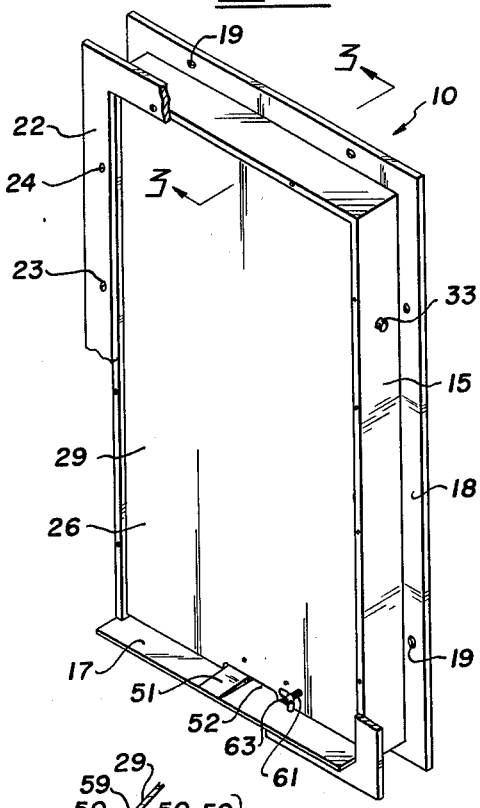
Figure 3:
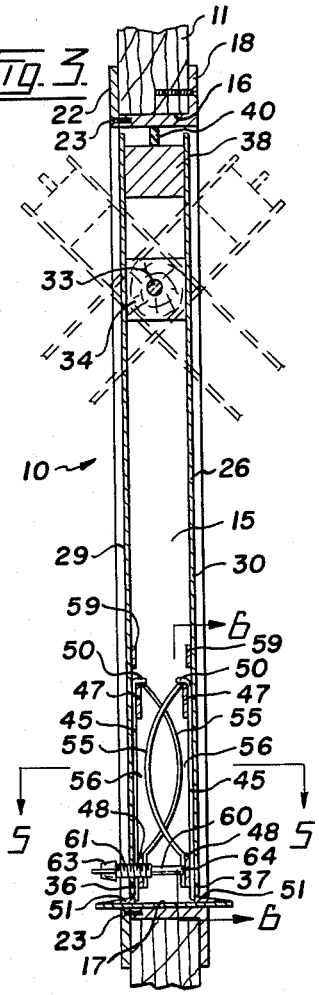
Figure 4:
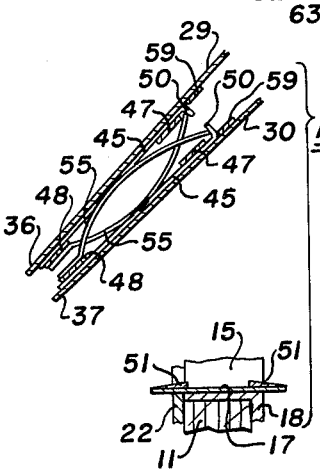
Figure 6:
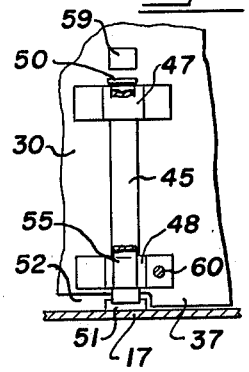
Figure 5:
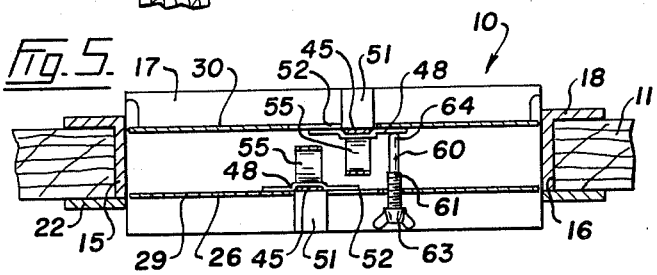

A preferred form of the invention is illustrated, by way of example, in the accompanying drawings, in which:

FIG. 1 is a reduced elevation of a house door with the door apparatus of this invention mounted therein, FIG. 2 is an enlarged perspective view of the door apparatus, FIG. 3 is a vertical section taken on the line 3—3 of FIG. 2, showing the apparatus in its normal closed position, FIG. 4 is a fragmentary sectional view similar to FIG. 3, but showing the door apparatus swung partly open, FIG. 5 is a cross section taken on the line 5—5 of FIG. 3, and FIG. 6 is a fragmentary section taken on the line 6—6 of FIG. 3, showing the latch of one of the panels.

Referring to the drawings, 10 is an automatic latch door apparatus in accordance with this invention shown as being mounted in a house door 11 near the lower edge thereof. The size of apparatus 10 and its position in the door will depend upon the size of the pet that will be moving into and out of the building. As stated above, the door apparatus 10 can be mounted in a wall or other structure. The purpose of the illustrated apparatus is to permit pets to pass through door 11 without anyone having to open said door.

In this example, apparatus 10 includes a rectangular frame 15 adapted to fit into a relatively small opening 16 in door 11 near the bottom edge thereof. This frame includes a threshold 17 extending across the bottom thereof, an outer flange 18 along its top, bottom and two sides which is adapted to bear against the outer surface of the door and to be secured thereto in any suitable manner, such as by screws extending through holes 19 in the flange. An inner flange 22 extends along the top, bottom and the two sides of frame 15 and is secured thereto by screws 23 extending through holes 24 in this flange and into the adjacent edge of frame 15.

A small door or closure 26 is fitted within and normally closes the opening formed by frame 15. This closure is formed by identical and spaced inner and outer panels 29 and 30. Hinge means is provided for these panels, and in this example the panels are mounted to swing as a unit around a rod 33 extending between and supported by the side edges of frame 15 spaced below the top edge thereof and below top edges of panels 29 and 30, as shown in FIG. 3. In this example, a block 34 is fitted between the two panels and is journalled on rod 33. Panels 29 and 30 are relatively thin so that the lower edges 36 and 37, respectively, can be moved towards and away from each other, or alternatively, if the panels are relatively stiff they can be independently mounted on rod 33 so as to swing about said rod. A counterweight 38 is positioned between and secured to panels 29 and 30 near the upper edges thereof and above rod 33. It is desirable to provide a weather strip 40 extending the length of the upper surface of counterweight 38 and projecting from the upper edge of closure 26 to engage the adjacent surface of frame 15 when the closure is in the closed position.

Suitable latch means is provided for each of the panels 29 and 30 at the lower edge thereof, and operating means is provided for each latch means. As both latch means and their respective operating means are identical, only one set will now be described in detail, the same reference numerals being used for the identical parts of the two panels.

Referring to panel 29, a latch bar 45 is slidably mounted for vertical movement on the inner surface of this panel. For example, this latch bar can slidably extend beneath upper and lower guide straps 47 and 48 secured to the inner surface of the panel. The upper end of bar 45 is bent over to form a lug 50 which engages the upper edge of guide 47 to limit the downward movement of the latch bar. At this time, the lower end of the latch bar extends downwardly beyond the lower edge of panel 29 and inside a stop 51 secured to threshold 17. The panel is provided with a notch 52 in its lower end over stop 51 so that the panel can swing inwardly and outwardly relative to frame 15.

The operating means of panel 29 consists of a bowed leaf spring 55 secured at its lower end to strap 48 and thereby to panel 29. This spring curves upwardly and outwardly from its lower end towards panel 30 but is normally spaced therefrom as indicated at 56 in FIG. 3. The upper end of spring 45 extends under and engages lug 50 of the adjacent latch bar. When panel 29 and spring 55 are in their normal positions, latch bar 45 is in its normal position with its lower edge projecting down below panel 29 and engaging the inner surface of the adjacent stop 51. A stop 59 may be secured to the inner surface of panel 29 above lug 50 to limit the upper movement of latch bar 45.

When the door or closure 26 hangs in its normal position, panels 29 and 30 hang in substantially vertical planes, and the two latch bars 45 engage the inner surfaces of their respective stops 51. At this time, the closure cannot swing inwardly or outwardly. It is preferable to provide lock means operable from inside the closure to lock it in the closed position. In this example, the lock means consists of a pin 60 having a threaded portion 61 which is threaded through panel 29 near the lower edge thereof. This pin has a head 63 on its outer end, and its opposite end 64 engages panel 30 when the pin is screwed into its inner position. At this time, panels 29 and 30 cannot move towards each other and therefore closure 26 is locked in the closed position.

When closure 26 is to be left so that a pet can walk in or out relative to door 11 without the latter being opened, pin 60 is screwed out so that it is spaced from panel 30. The closure cannot be opened by wind because of the fact that latch bars 45 are engaging stops 51 at this time. The lower edges and the side edges of panels 29 and 30 just clear threshold 17 and the sides of frame 15. The weather strip 40 engaging the top portion of the frame prevents air from passing through the frame.

If the pet desires to go out, for example, when it strikes panel 29 with its paw, head or body the lower edge of the panel moves towards panel 30 until said panel engages spring 55 of the outer panel. Continued movement of the inner panel tends to flatten out the spring and this raises latch bar 45 of the outer panel until it clears the outer stop 51. At this time, the closure is free to swing outwardly around bar 33 as the pet walks through the opening. As the entire closure is preferably formed of relatively light material such as aluminum, it offers very little resistance to the movement of the pet. When the pet clears the closure, the closure swings back to its normal position, counterweight 38 slowing this down a little so that it is a quiet operation. It will be noted that stops 51 are bevelled so that they form ramps which press the latch bars 45 upwardly as the door or closure closes, and when the latch bars clear their respective stops, they drop down to engage the inner surfaces thereof and thereby latch the closure in the closed position, as shown in FIG. 3.

The operation is the same when the pet presses against the outer panel 30, excepting that this panel engages the spring 55 of the inner panel to raise the latch bar of the latter so that the closure can swing inwardly.

As counterweight 38 is located close to the pivot rod 33 relative to the lengths of the portions of the panels projecting downwardly from this rod, the closure will always swing closed when it is released. As the closure swings to the vertical position, it automatically latches in the closed position. The latches are such that they are released and the closure opened by pressure against the outer surface of either of the panels 29 or 30. If it is desired to lock the closure so that it cannot be opened, it is only necessary to screw pin 60 in until it engages the opposite panel. This prevents either panel from being pressed out of its normal plane since the latch of the opposite panel thereto will prevent this. This door apparatus is of relatively simple and inexpensive construction, it prevents drafts from traveling through the opening controlled by the apparatus, it is quiet in operation, and it is of pleasant appearance so that it does not mar the appearance of door 11.

As previously stated, it is obvious that apparatus 10 can be mounted in a wall. Furthermore, it may be tipped over into a position at right angles to its preferred position, in which case it will be necessary to provide spring means for returning the closure to its normal position each time it is moved out of that position. This would be a simple thing to do, for example, a coil spring around rod 33 could be used having one end anchored to the rod and an opposite end bearing against the inner surface of one of the panels. It would be possible to enlarge this door apparatus so that it could act as a complete door in itself. Such a door would be useful in places where people have to travel through the doorway with their arms full. In this case, it would only be necessary to press against one of the panels of the door to unlatch and then swing it to the open position. When a person clears the door, it would return to its normal position and be latched therein.

I claim:

1. Automatic latch door apparatus comprising spaced panels forming a closure normally located in a closing position in vertical planes and having adjacent edges movable out of said planes on either side thereof, latch means on each of said panels near said edge thereof and normally preventing movement thereof in the direction away from the other of said panels while permitting movement in the direction towards said other panel, and operating means on each panel operatively connected to the latch means on said each panel, the operating means of each panel being positioned to be engaged and operated by the other panel when said other panel is moved towards said each panel thereby operating the latch means of and consequently releasing said each panel to permit the latter to move with said other panel.

2. Automatic latch door apparatus as claimed in claim 1 in which said adjacent edges are lower edges of the panels, and including hinge mounting means near upper edges of said panels from which said panels hang.

3. Automatic latch door apparatus as claimed in claim 2 in which said hinge mounting means is spaced downwardly from the upper edges of the panels, and including a counterweight carried by said closure above the hinge mounting means.

4. Automatic latch door apparatus as claimed in claim 1 comprising lock means mounted on one of said panels and operable to prevent movement of the panels towards each other.

5. Automatic latch door apparatus comprising spaced panels forming a closure and normally hanging in a vertical closing position and hung to swing as a unit out of their normal planes on either side thereof, a latch mounted on each of said panels near a lower edge thereof normally projecting from said edge, a stop located near said each panel and positioned to be engaged by the latch of said each panel to prevent movement thereof in the direction away from the other of said panels while permitting movement in the direction towards said other panel, operating means on each panel operatively connected to the latch on said each panel, the operating means of each panel being positioned to be engaged and operated by the other panel when said other panel is moved towards said each panel thereby operating the latch of said each panel to disengage the adjacent stop and consequently release said each panel to permit the latter to move with said other panel.

6. Automatic latch door apparatus as claimed in claim 5 comprising hinge mounting means near upper edges of said panels from which said panels hang.

7. Automatic latch door apparatus as claimed in claim 6 in which said hinge mounting means is spaced downwardly from the upper edges of the panels, and including a counterweight carried by said closure above the hinge mounting means.

8. Automatic latch door apparatus as claimed in claim 5 in which the latch of each panel comprises a latch bar slidably mounted on an inner surface of said each panel and movable between a normal extended positon to engage the adjacent stop and a retracted position to disengage said stop, the operating means of said each panel being connected to the latch bar thereof to move said bar to the retracted position when said operating means of said each panel is engaged by the other panel.

9. Automatic latch door apparatus as claimed in claim 8 in which the operating means of each panel comprises a bowed leaf spring secured at one end to said each panel and having an opposite end connected to the latch bar, each leaf spring being compressible and having a central section curved outwardly near and normally spaced from the inner surface of the other of said panels, whereby when said each panel is swung towards said other panel, the central section of the spring of said each panel engages said other panel to be compressed thereby to cause said spring to move its latch bar to the retracted position.

10. Automatic latch door apparatus as claimed in claim 5 comprising lock means mounted on one of said panels and operable to prevent movement of the panels towards each other.

11. Automatic latch door apparatus as claimed in claim 10 in which said lock means comprises a locking pin threaded in one of said panels and extending towards and normally terminating short of the other of said panels, whereby said pin can be screwed in to engage said other panel to prevent movement of said panels towards each other.

* * * * *